United States Patent [19]

Gregoire et al.

[11] 4,205,504

[45] Jun. 3, 1980

[54] METHOD AND DEVICE FOR MAKING ENVELOPES FROM A CONTINUOUS WEB AND INCLUDING THE STUFFING AND SEALING OF THOSE ENVELOPES

[75] Inventors: Clyde G. Gregoire, Bensenville; James A. Hartman, Brookfield; Joseph M. Gregoire, Berwyn, all of Ill.

[73] Assignee: Gregg Engineering Corp., Lyons, Ill.

[21] Appl. No.: 938,933

[22] Filed: Sep. 1, 1978

[51] Int. Cl.[2] ..... B65B 43/04; B65B 63/00

[52] U.S. Cl. ..... 53/520; 53/562; 53/206; 53/266 A

[58] Field of Search ..... 53/455, 460, 435, 520, 53/562, 206, 266 A

[56] References Cited

U.S. PATENT DOCUMENTS

| | | | |
|---|---|---|---|
| 964,077 | 7/1910 | Williams et al. | 53/520 |
| 1,122,519 | 12/1914 | Lovercheck | 53/266 A |
| 2,290,564 | 7/1942 | Krueger | 53/455 X |
| 2,649,671 | 8/1953 | Bartelt | 53/455 |
| 2,923,111 | 2/1960 | Selock | 53/455 |
| 3,339,337 | 9/1967 | Rapp et al. | 53/562 |
| 3,593,485 | 7/1971 | Stovall | 53/460 X |
| 3,618,284 | 11/1971 | Gendron | 53/460 |
| 3,641,733 | 2/1972 | Lerner | 53/455 |
| 3,728,840 | 4/1973 | Izumi | 53/562 |
| 3,808,768 | 5/1974 | Dobbs | 53/460 |

*Primary Examiner*—John Sipos
*Attorney, Agent, or Firm*—Kenneth T. Snow

[57] ABSTRACT

A continuous paper web is fed in a longitudinal path. Glue is applied in transverse strips at regular intervals along the longitudinally disposed continuous web over a part only of the width of the web. A first plow folds over a portion of the web having the transverse glue strips to a position above an adjacent flat portion of the web. An insert or stuffer is fed into the web between the folded over portion and the flat portion and against an inner crotch thereof formed by the fold line. The space between the folded over portion and the flat portion away from the fold is open and forms a wide mouth to readily receive the inserts delivered thereto. This first folded over portion is then closed down over the inserts lying on the flat portion causing the glue strips to seal onto the flat portion. The folded over portion and the flat portion of the web contain inserts between each of the transverse glue strips. A glue strip is applied longitudinally to the web on the flat portion thereof not having a folded over portion thereabove. A second plow acts to fold the longitudinally glued flap strip over onto the top of the folded over portion to thereby seal the top of the formed envelope. The continuous web is then sheared transversely at each transverse glue strip to thus divide the continuous web into multiple individual stuffed and sealed envelopes.

3 Claims, 14 Drawing Figures

116
117
118
119
120
121
122
123
124
125
126
127
128
129
130
131
132
133
134
135
136
137
138
139
140
141
142
143
144
145
146
147
148
149

METHOD AND DEVICE FOR MAKING ENVELOPES FROM A CONTINUOUS WEB AND INCLUDING THE STUFFING AND SEALING OF THOSE ENVELOPES

BACKGROUND OF THE INVENTION

1. Field of the Invention

The present invention concerns a method and device for making envelopes and the stuffing of those envelopes at a time when the envelopes are still relatively open for easy insertion of the stuffers.

Advertising by mail holds a prominent place in our present society. Companies wishing to advertise their products and services develop or purchase mailing lists of prospective customers. Business is solicited from each of the persons on the mailing lists by sending them advertising materials. Thus the stuffing of envelopes with advertising inserts is big business. It is with this in mind that applicants have developed their device and method of inserting stuffers into envelopes at a stage in the envelope production when they are not yet closed and it is easy to insert stuffers. Also, newspaper publishers have discovered a lucrative supplement to their income by distributing various companies advertising materials with their newspapers. Recently the Sunday newspapers have had great numbers of these "flyers" or advertising pieces and they are easily lost because of their smaller size. It is another contemplated use of the present invention to insert all of these supplement stuffers into one large envelope to thereby insure delivery of all of the advertising sheets and folders to every newspaper customer.

Envelopes have been previously automatically stuffed but as a rule those stuffings have been made into pre-formed envelopes. When pre-formed envelopes are used it is necessary to employ means such as air streams to open the envelopes for easy reception of the stuffers or inserts. In the present invention the envelopes being manufactured are not closed until after the stuffers are delivered into the envelopes and thus applicants' present invention simplifies the stuffing of envelopes.

Applicants' invention contemplates the insertion into envelopes of plural stuffers whether those plural stuffers are inserted all at one station or at a plurality of stations. Also, applicants' invention further contemplates the manufacture of both the envelopes and the stuffers from a single pre-printed continuous web so that with a single web being introduced the output is a plurality of sealed and stuffed envelopes.

2. Description of the Prior Art

A search of the prior art has produced a variety of patents showing continuous web folding and cutting and including envelope construction and assemblies.

The Volks et al. U.S. Re. Pat. No. 25,961 shows and describes a device for assembling inserts into envelopes during their formation. However, in this prior patent the envelopes are formed from pre-cut blanks completely separated from a continuous paper web prior to any insertion of stuffers.

The Steidinger U.S. Pat. No. 3,104,799 relates to an envelope assembly and is concerned among other things with the registration of plies of insert sheets during imprinting and providing a tear strip on the plies of insert sheets for tearing open a sealed envelope. This is not a teaching of envelope manufacture from a continuously printed web such as is applicants' invention.

The Johnson et al U.S. Pat. No. 3,104,800 shows a bank envelope constructed to have a deposit slip formed as a part of the envelope and including a perforation strip to permit easy removal of the deposit slip for the manual insertion into the envelope by the bank customer.

The Green U.S. Pat. No. 4,052,752 relates to the making of a disposable garment from a continuous paper web. This is not envelope construction but it does disclose the use of glue and the formation of an object, in this case a garment, from a continuous web. Here also, separate continuous webs are used to form different parts of the garment and are attached to the garment of the first web by glue strips. This does not anticipate the envelope making, stuffing and sealing as applicants do in their invention.

The Traise U.S. Pat. No. 4,055,294 shows a composite mailer and return envelope assembly. In this prior patent the insert material constitutes the envelope body as it is folded and perforations permit the envelope to be torn open. Again, this does not anticipate applicants' invention of stuffing envelopes during their formation and the subsequent sealing thereof.

Our own earlier patent to Gregoire U.S. Pat. No. 3,857,314 is directed to a rotary cutter of continuous paper webs and could be useable in the making of the envelopes of this invention. Similarly our own earlier patent to Gregoire et al. U.S. Pat. No. 4,047,711 on an adjustable paper plow is utilized in the present invention in the folding over of web portions involved in the making of envelopes and stuffing them during their formation. Still further our own earlier patent to Gregoire et al U.S. Pat. No. 4,073,485 relating to the making of multiple page printed booklets could be an important adjunct in the making of envelope stuffers in the combination invention shown and described herein.

SUMMARY OF THE INVENTION

A principal object of the present invention is to manufacture envelopes from a continuously moving paper web and to effect a stuffing of an insert or inserts into the envelopes prior to the time of final formation of the envelopes so there is no necessity of employing a separate step to open the envelopes.

An important object of this invention is to provide a novel device for making envelopes from a continuous pre-printed paper web and including means to hold the envelopes open during a stage in their production at which time stuffers are inserted and the envelopes thereafter completed, sealed and separated from the continuous web.

Another important object of this invention is to provide a novel method and device for manufacturing envelopes and stuffers, such as advertising material, from a single, continuous, moving paper web and including the desired folding and insertion of the stuffers into the envelopes prior to the completion of the envelope with the result that the final output is separate stuffed and sealed envelopes.

Still another important object of this invention is to provide a novel means for holding a partially formed envelope at a fold over bottom and simultaneously holding the opposite top side open during insertion of stuffers therein.

Other and further important objects and advantages will become apparent from the disclosures in the following specification and accompanying drawings.

IN THE DRAWINGS

AS SHOWN IN THE DRAWINGS

Figures 1, 2, 3, 4, 5, 6, 7, 8:
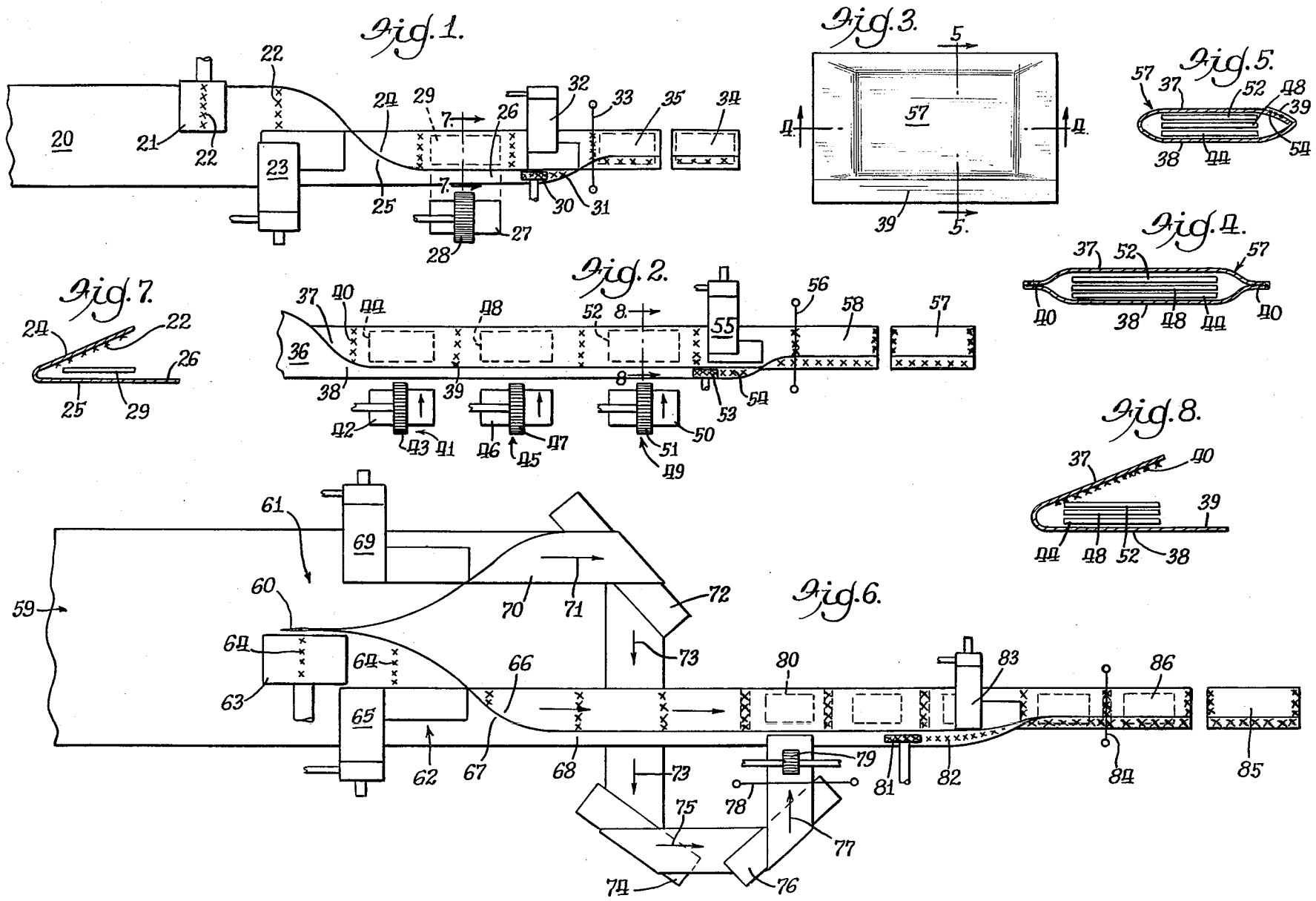
FIG. 1 is a top plan view of the envelope making and stuffing device of this invention shown in a somewhat diagrammatic form.
FIG. 2 is a top plan view of a portion of a device similar to that shown in FIG. 1 but modified to include plural stuffing stations.
FIG. 3 is a plan view of a completed and stuffed envelope made on the device as shown in FIG. 2.
FIG. 4 is an enlarged sectional view taken on the line 4—4 of FIG. 3.
FIG. 5 is an enlarged sectional view taken on the line 5—5 of FIG. 3.
FIG. 6 is a top plan view similar to FIGS. 1 and 2 but showing a modified form to the device of this invention.
FIG. 7 is an enlarged sectional view taken on the line 7—7 of FIG. 1.
FIG. 8 is an enlarged sectional view taken on the line 8—8 of FIG. 2.

The reference numeral 20 indicates generally a continuous paper web from which envelopes are made. A glue applicator 21 in the form of a roller is adapted to dispense a transverse strip of glue 22 onto the longitudinally moving paper web 20. The transverse glue strips 22 extend over only a short portion of the entire width of the continuous web and are disposed at regular intervals along the web. A plow folder 23 is arranged and constructed to fold the portion 24 of the web which has the intermittently carried transverse glue strips 22 over a remaining portion of the web 20. This remaining portion designated by the numeral 25 is flat and is located beneath the folded over portion 24. A strip of flat web portion 26 which ultimately becomes the envelope top flap extends out from the flat portion 25 and does not lie beneath the fold over portion 24. A stack of envelope stuffers or inserts 27 is disposed adjacent the side of the continuous paper web 20 located at a longitudinal position where the folded over portion 24 is disposed above the flat portion 25. A feed wheel 28 acts to deliver stuffers from the top of the stack 27 into the open envelopes being formed. This feature of FIG. 1 is also shown in FIG. 7. The web portion 24 is disposed in a V-relationship with its cooperative flat web portion 25. This V arrangement presents a substantially wide open mouth for the reception of stuffers into the partially formed envelope. The stuffer is identified by numeral 29 within this partially formed envelope. A glue applicator 30 acts to spread a longitudinally extending glue strip 31 on the uncovered flap 26 of the continuous paper web 20. This glued envelope flap 26 is utilized to fully enclose the envelope at its top side. A plow folder 32, similar to the plow folder 23 and constituting a plow such as shown in our earlier Gregoire et al. U.S. Pat. No. 4,047,711, is used to turn over the glued flap 26 onto the top of the previously folded over portion 24. A vertical shear 33 is employed to sever the continuous paper web after it has been formed into envelopes by the device just described. The vertical shear cuts on each of the transverse glue strips thereupon severing the completed and stuffed envelope 34. The longitudinal spacing of the transverse glue strips thus determines the length of the envelopes being made. An unsevered stuffed and sealed envelope 35 is shown just prior to being cut loose from the web 20 by the vertical shear 33.

As best shown in FIG. 2 a continuous paper web 36 similar to the paper web 20 of FIG. 1 is utilized to make envelopes with plural stuffers. The initial handling of the web 36 is identical to that shown for the web 20 in FIG. 1. This handling includes a transverse glue applicator and a plow folder such as those shown at 21 and 23 respectively in FIG. 1. These elements have not been shown again in FIG. 2. The web 36 has a folded over portion 37 which is disposed above a flat portion 38. The web further includes a strip of flat portion 39 which extends forwardly of the flat portion 38. This strip 39 is not disposed beneath the folded over portion 37. Transverse glue strips 40 are located on the underside of the folded over portion 37 at regular intervals therealong. It is these transverse glue strips 40 which define the length of the envelopes being made.

A first stuffer station 41 is located adjacent the continuous paper web 36 at a position where the web portion 37 has just been turned over the flat web portion 38. The first stuffer station 41 includes a stack of inserts or stuffers 42 and a feed wheel 43 thereabove to cause the top of the stack of inserts to be propelled into the partially formed envelope between the spaced apart transversely disposed glue strips 40. As shown in FIG. 2 an insert 44 has been moved from the stack 42 to a position within the partially formed envelope. The continuous web 36 moves longitudinally from left to right as shown in FIG. 2. A second stuffer station 45 is provided alongside the web 36 where an additional insert is propelled into the partially formed envelopes. The second station 45 includes a stack of inserts 46 and a feed wheel 47 thereabove to propel the top insert from the stack 46 into the continuous paper web. This insert within the envelope being formed is designated by the numeral 48. A third stuffer station 49 is located still further down the line adjacent the web 36. An additional stuffer is caused to be placed in the partially formed envelopes at this third station which includes a stack of inserts 50 and a feed wheel 51. A third insert 52 is shown in the partially formed envelope formed in the continuous paper web 36. It should be apparent that any number of stations may be provided adjacent the continuous paper web such as those shown in FIG. 2 to cause a plurality of stuffers or inserts to be put into the envelopes as they are being formed. As shown in the sectional view of FIG. 8 it is clear that the inserts are stacked one over the other as they are put in from each of the succeeding stations. The insert 44 is on the bottom closely adjacent the flat portion 38 of the continuous paper web 36. The next insert 48 is disposed above the insert 44 and is in the center of the plural inserts within the partially formed envelope. The last insert 52 is disposed over the second insert 48 and immediately below the folded over portion 37 of the continuous paper web 36. It is preferable that the partially formed envelopes be open so that they have a relatively wide mouth as shown in FIG. 8 when the stuffers or inserts are being propelled therein. However, with a lesser number of inserts it is possible to cause them to be automatically inserted even though the folded over portion is substantially down against the flat portion of the continuous paper web.

A glue applicator 53 is provided along the continuous paper web 36 just beyond the last insert station 49. This glue applicator lays a longitudinal glue strip 54 on the envelope flap 39. A plow 55 is adapted to turn over the flap 39 and cause it to lie on and be sealed against the top surface of the folded over portion 37 of the continuous paper web. The plow folder 55, as stated for the plow folders 23 and 32, is preferably of the type disclosed in applicants' prior U.S. Pat. No. 4,047,711.

A vertical shear 56 similar to the vertical shear 33 is adapted to sever the formed continuous paper web along its transverse glue strips 40 and thus cause a separation of the formed, multiple stuffed and sealed envelopes. The first severed envelope is shown at 57 and the envelope about to be sheared from the continuous strip 36 is designated by the numeral 58. FIGS. 3, 4 and 5 are all showings of the severed envelope 57 as made on the device of FIG. 2. FIG. 3 is a top plan view, somewhat enlarged, showing the completed, stuffed and sealed envelope 57. FIG. 4 is a longitudinal sectional view taken through the envelope 57 showing the end seams along spaced apart transverse glue lines 40 with the included multiple inserts 44, 48 and 52. FIG. 5 shows a transverse sectional view of the envelope 57 including the multiple inserts 44, 48 and 52 and the sealing of the top flap 39 over onto the top surface of the folded over portion 37 of the continuous paper web 36.

A third form of the invention is shown in FIG. 6 wherein the envelope and the inserted stuffer are both made from a single initial strand of continuous preprinted paper web 59. A web slitter 60 is located beneath the longitudinal path of travel of the printed web 59 causing that web to be divided into a first strand 61 and a second strand 62. The first strand 61 eventually constitutes stuffers which are inserted into partially formed envelopes made from the second divided strand 62. The second strand 62 is very similar to the entire strand 20 shown in FIG. 1. A glue applicator 63 imparts a transverse glue strip 64 at regular intervals onto the surface of the strand 62. A plow 65 preferably of the type shown in applicants prior U.S. Pat. No. 4,047,711 is adapted to turn over a portion 66 of the divided strand 62. This portion 66 has the transverse glue strips thereon and when folded over the glue strips are located on the underside so that when the portion 66 is ultimately pressed down onto a remaining flat portion of the web it causes a sealing therewith. The flat portion of the web strand 62 located directly beneath the folded over portion 66 is identified by the numeral 67. A further flat strip portion 68 of the divided strand 62 is not covered by the fold over portion 66 and becomes the envelope flap as will later be described.

A paper plow 69 is arranged and disposed to cause the first divided strand 61 to be folded over upon itself making a folded strand 70. Again, the plow 69 is preferably of the type shown in applicants' earlier U.S. Pat. 4,047,711. An arrow 71 shows the direction of movement of the folded stuffer strand 70 to be in a longitudinal direction. The folded strand 70 continues that longitudinal movement until it arrives at a turning bar 72 which is used to change directions of the strand. The folded strand 70 turns down under the bar 72 and thence at right angles to its initial movement. The arrow 73 shows the folded strand 70 passing transversely beneath the folded over envelope formation of the second divided strand 62. The folded strand 70 thereupon reaches another right angle turning bar 74 which acts to direct the folded strand 70 up over the top of the bar 74 and thence longitudinally as shown by the arrow 75. Thus the folded strand 70 which ultimately becomes the stuffers used for filling the envelopes now resumes its longitudinal movement but on the other side of the envelope formation divided strand 62. A still further turning bar 76 is located in a plane slightly above the turning bar 74 so that it receives the longitudinally moving folded strand 70 on its underside thereupon turning the strand up over the top of the bar and thence laterally inwardly in the direction of the arrow 77. The arrow 77 indicates a transverse movement of the folded strand toward the second divided strand 62 of the continuously preprinted paper web 59. A vertical shear 78 is utilized to sever the folded strand 70 into separate individual stuffers. It should be understood that at this position applicants' device for making multiple page printed booklets as depicted in their prior U.S. Pat. No. 4,073,485 could be employed and thereby fold the stuffers crosswise in addition to the longitudinal folds prior to inserting those stuffers into the partially formed envelopes. A feed roll 79 is adapted to move the severed stuffers, as identified by the numeral 80, into the partially formed envelopes made from the second divided strand 62. A glue applicator 81 is adapted to apply a longitudinally disposed glue strip 82 on the flat flap portion 68 of the envelope being formed. A paper plow 83 preferably a device such as shown in applicants prior U.S. Pat. No. 4,047,711 is used to fold the glued flap 68 over and onto the top of the previously folded over portion 66 of the preprinted paper web 59. A vertical shear 84 is provided across the path of the second divided strand 62 at the position of the completion of the folding over of the flap 68 to thereby separate the completed stuffed and sealed envelopes all made from the single continuous preprinted paper web 59. A severed completed envelope is shown at 85 and a non-separated envelope 86 is shown still as a part of the second divided strand 62 immediately prior to its being severed therefrom in the manner of the envelope 85.

Three modifications of the present invention have been shown in FIGS. 1, 2 and 6. In FIG. 1 the operation of the device is to provide a continuous preprinted paper web, apply transverse and longitudinal glue strips onto that paper web in the manner described and with the aid of plow folders form an envelope from the continuous paper web. During the formation of the envelope, stuffers from a separate source of supply are inserted into the envelope and thereafter the envelopes are completed and then severed from the continuous paper web. Each envelope is filled with a stuffer and sealed on all four sides so that it is ready for mailing. The device of FIG. 2 is substantially the same as that device of FIG. 1 but for the fact there is provided several stations at which separately supplied stuffers may be and are inserted into the partially formed envelopes which are thereafter sealed and severed from the input of continuous paper web. The third form of the invention is that shown in FIG. 6 wherein a single continuous preprinted paper web is divided so that a portion thereof is used as the stuffer which is inserted into the other portion of the paper web which is used to form the envelopes. Thus the device of FIG. 6 has only one input material to provide completed, stuffed and sealed envelopes ready for mailing or other use as desired.

Figure 9:
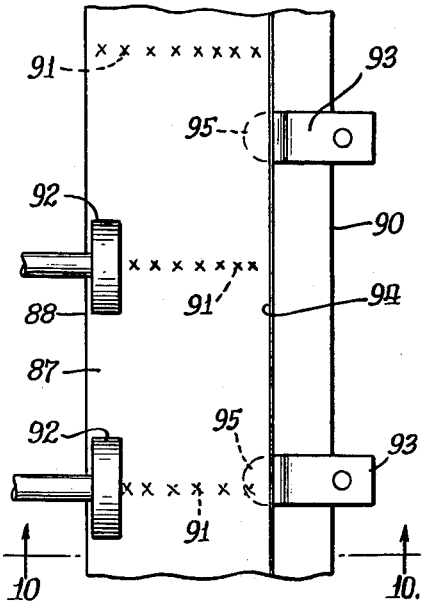
FIG. 9 is an enlarged top plan view of a device useable in conjunction with any one of the devices of FIGS. 1, 2 and 6.
Figure 10:
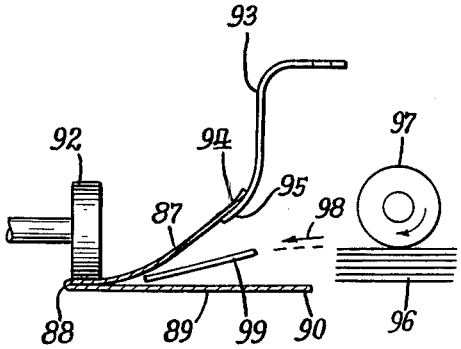
FIG. 10 is a sectional view taken on the line 10—10 of FIG. 9.

FIGS. 9 and 10 of the drawings show the optional use of auxiliary elements to facilitate the insertion of stuffers into the partially formed envelopes whether it be the form of invention shown in any one of FIGS. 1, 2 and 6. A folded over portion 87 of a continuous paper web has a longitudinally extending fold line 88 and an adjoining flat portion 89 directly beneath the folded over portion 87. A flap or strip of flat portion 90 is not covered by the folded over portion 87 and acts subsequently as the top flap sealing portion for the envelope being made. This then could constitute a device such as shown in FIG. 1 by the folded over portion 24 onto the flat portion 25 or in FIG. 2 by the folded over portion 37 onto the flat portion 38 or in FIG. 6 by the folded over portion 66 onto the flat portion 67. As in all of the devices shown in FIGS. 1, 2 and 6 the showing in FIG. 9 is similar in that it is provided with transverse glue lines 91 on the underside of the folded over portion 87 of the continuous preprinted paper web used in this device. At each stack feeding station whether shown in FIGS. 1, 2 or 6, feed wheels are utilized to propel a stuffer or insert into a partially completed envelope. It has been found that it is desirable under some conditions to have a means for backing up the folded over web portion to cause the propelled stuffer to halt at the inner end of the V-crotch formed by the folded over portion of the continuous web. In the modified optional device of FIG. 9 there is provided spaced apart pressure rollers 92 arranged such that their rolling surfaces extend in a longitudinal direction and bear down on the folded over portion 87 near the fold line 88. These rollers thus act to close the rearward or lefthand portion of the formed envelopes as viewed in the drawings. Cooperating with the pressure rollers 92 at the bottom edge of the envelopes are shoes 93 at the top edge of the envelopes. The shoes 93 are arranged to hold the folded over portion 87 spaced upwardly from the flat portion 89. The shoes 93 thus prevent the portion 87 from closing down onto the flat portion 89 until after the insert or inserts are located within the envelope and the envelope is ready for completion and severing from the continuous input paper web. The outer edge 94 of the folded over portion 87 is engaged on its underside by tips 95 extending outwardly from the shoes 93. This construction as shown in FIG. 10 clearly keeps the folded over portion 87 spaced upwardly from the flat portion 89. The folded over portion 87 and the flat portion 89 of the continuous preprinted paper web define a V-shape with the V laying in a horizontal position such that the wide open mouth permits easy insertion of stuffers. A stack of stuffers 96 is equipped with a feed wheel 97 thereover. Arrows 98 show the direction of delivery of the stuffers 96 into the envelope being formed. As shown in FIG. 10, a stuffer 99, from the stack 96 has been inserted into the wide mouth of the partially formed envelope. The pressure wheels 92 act as a cushion stop for the propulsion of the insert 99. Thereafter the envelopes are sealed at their ends by permitting the folded over portion 87 to come down over the insert 99 so that the transverse glue strips 91 cooperate with the flat portion 89. Thus the sealing of the envelopes at their ends in FIGS. 9 and 10 is accomplished in the same manner as that that shown in FIGS. 1, 2 and 6. The device of FIGS. 9 and 10 provides a cushioned stop for the stuffers and a means to insure that the partially formed envelopes will have wide open mouths as the stuffers are inserted therein.

Figure 11:
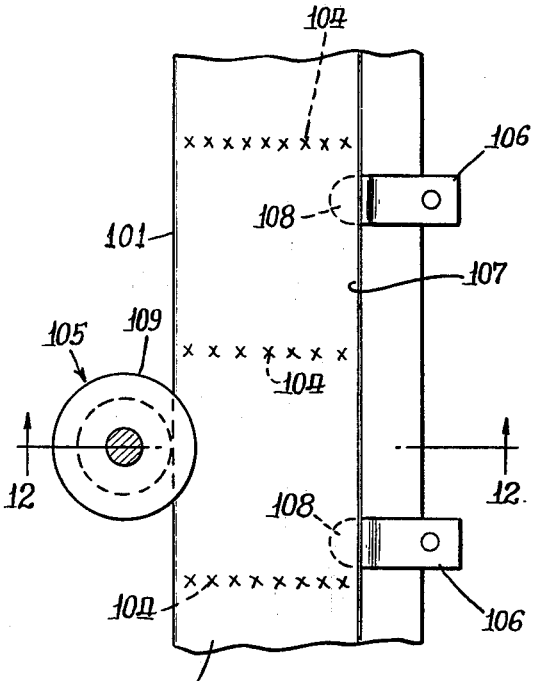
FIG. 11 is an enlarged top plan view of a device useable in any of the devices of FIGS. 1, 2 and 6.
Figure 12:
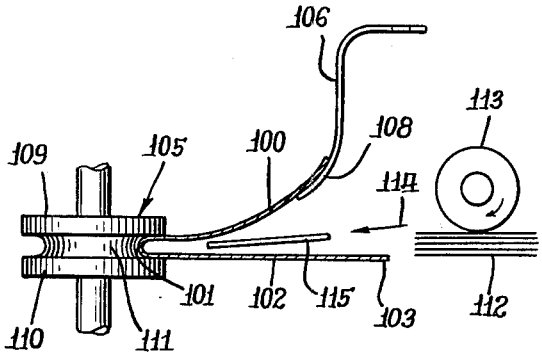
FIG. 12 is a sectional view taken on the line 12—12 of FIG. 11.

The device of FIGS. 11 and 12 of the drawings is a still further optional form of a stuffer cushioning mechanism and is an alternative for the device shown in FIGS. 9 and 10. Again, as in FIG. 9, FIG. 11 shows a folded over portion 100 of a continuous preprinted paper web. This folded over portion defines a longitudinally extending fold line 101 which joins a flat portion 102 of the web located directly beneath the portion 100. A flap or strip of flat portion 103 is not covered by the portion 100 and ultimately becomes the top flap seal for the envelopes being made. Transverse glue lines 104 are provided at regular intervals along the underside of the folded over portion 100 and act to seal the ends of the envelopes as the folded over portion 100 is permitted to come down to abutting engagement with the under portion 102 of the web. The device of FIG. 11 distinguishes from the device of FIG. 9 in the type of cushioning mechanism employed for the fold line edge 101 of the partially formed envelopes. A roller device 105 lies in a horizontal plane rather than a vertical plane such as the roller 92 of FIG. 9. The roller 105 is utilized to brake the stuffer propulsion as it is inserted. Using this special roller device 105 makes it possible for the stuffer to come to a cushioned halt within the partially formed envelope. Shoes 106 are provided on the other side of the continuous paper web. These shoes are adapted to engage the outer edge or lip 107 of the folded over portion 100 by means of tips 108 engaging the under side of the edge 107. This of course is similar to the shoes 93 of FIG. 9. The shoes 106 operate in the same manner as the shoes 93 and act to hold open the folded over portion of the continuous preprinted paper web during the time when stuffers are inserted into the partially formed envelopes. The roller device 105 is constructed with an outer circular flange 109, a spaced apart outer circular flange 110 and an included annular narrow groove 111. The roller element 105, lying in a horizontal plane and adapted to freely rotate about a fixed center has its narrow groove 111 engaging the longitudinally extending fold line 101 of the continuous web of folded over portion 100 and the flat portion 102. This is shown in both of FIGS. 11 and 12. The annular groove 111 thus backs up the fold line 101 and confines the spacing of the web elements 100 and 102 to a relatively closed position whereas the shoes 106 and their extending tips 108 act to keep the other side of the web members open to define a wide V-mouth for the easy insertion of stuffers therein. A stack of stuffers or inserts 112 has a feed wheel 113 mounted thereover. Stuffers are fed in the direction of the arrow 114 into partially formed envelopes. A stuffer 115 is shown within the envelope. The stuffer has been halted in its propelled movement by reason of the roller device 105 with its outer flanges engaging the top and underside of the web portions while the fold line 101 is shown lodged within the roller's annular groove 111.

Figures 13, 14:
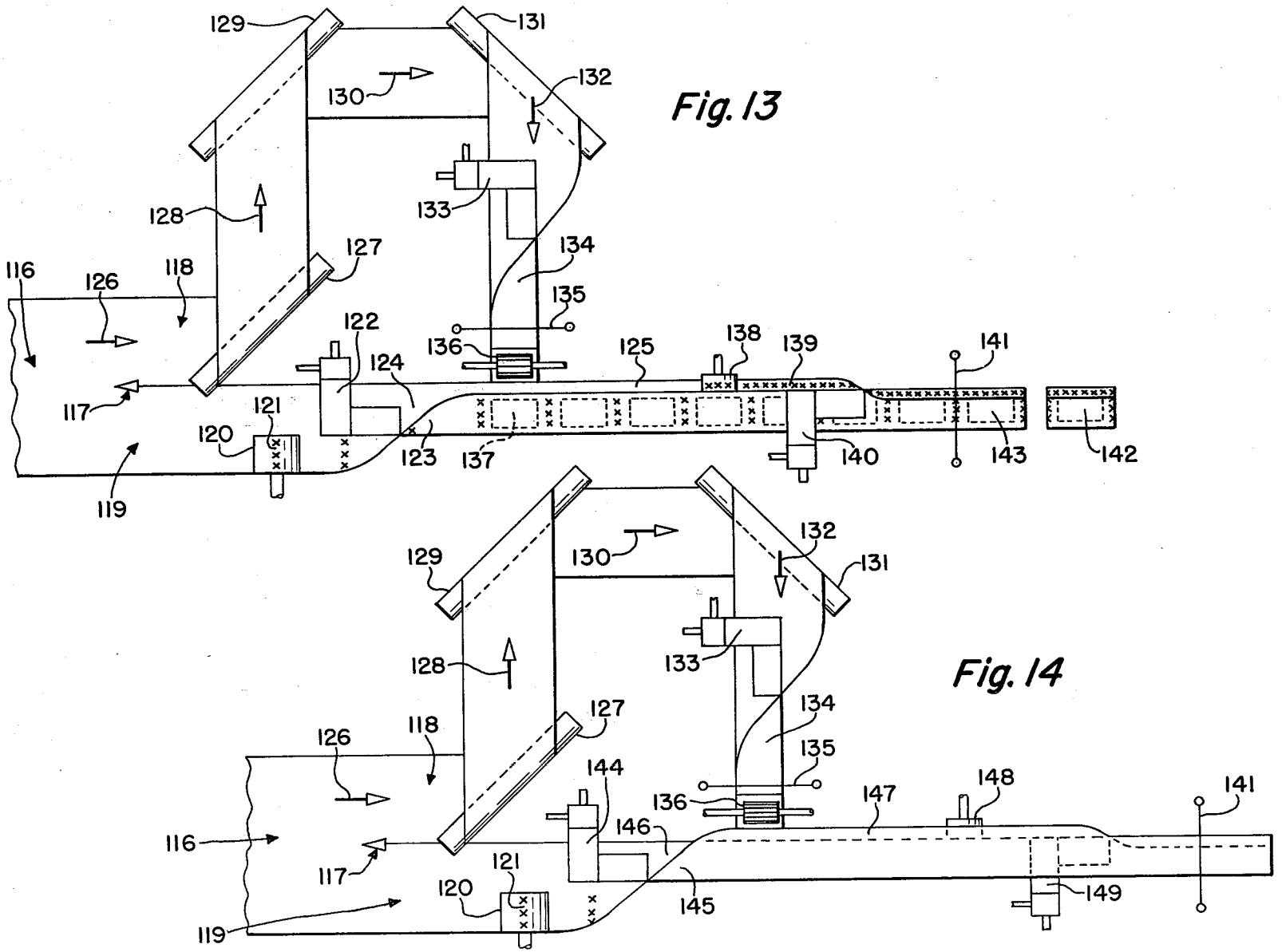
FIG. 13 is a top plan view of a modified envelope making and stuffing device which is somewhat similar to the device of FIG. 6.
FIG. 14 is a top plan view of still another modified envelope making and stuffing device and differs from the device of FIG. 13 in that the completed and stuffed envelopes have their address receiving side facing upwardly.

Another modified form of the invention is shown in FIG. 13 wherein the envelope and the inserted stuffer are both made from a single initial strand of continuous preprinted paper web 116. This is the same as in the modified form of FIG. 6. A web slitter 117 is located beneath the longitudinal path of travel of the printed web 116 causing that web to be divided into a first strand 118 and a second strand 119. The first strand 118 eventually constitutes stuffers which are inserted into partially formed envelopes made from the second divided strand 119. The second strand 119 is very similar to the entire strand 20 shown in FIG. 1. A glue applicator 120 imparts a transverse glue strip 121 at regular intervals onto the surface of the strand 119. A plow 122 preferably of the type shown in applicants' prior U.S. Pat. No. 4,047,711 is adapted to turn over a portion 123 of the divided strand 119. Here the portion is turned inwardly rather than outwardly as in FIG. 6. This portion 123 has the transverse glue strips thereon and when folded over the glue strips are located on the underside so that when the portion 123 is ultimately pressed down onto a remaining flat portion of the web it causes a sealing therewith. The flat portion of the web strand 119 located directly beneath the folded over portion 123 is identified by the numeral 124. A further flat strip portion 125 of the divided strand 119 is not covered by the fold over portion 123 and becomes the envelope flap as will later be described.

An arrow 126 shows the direction of movement of the stuffer strand 118 to be in a longitudinal direction. The strand 118 continues that longitudinal movement until it arrives at a turning bar 127 which is disposed at an angle of approximately 45° to the longitudinal direction of the strand and is used to change the direction of movement of the strand. The strand 118 comes in under the bar 127 and passes over the top thereof and thence moves transversely outwardly in the direction of the arrow 128 at a right angle to its initial longitudinal movement. The strand 118 moving transversely outwardly passes over another diagonally disposed turning bar 129 and thence under the bar to cause the strand to turn at right angles and again move longitudinally as shown by the arrow 130. A still further diagonally disposed turning bar 131 is employed to effect another right angle turning of the strand 118. The turning bar 131 receives the longitudinally moving strand 118 on its underside thereupon turning the strand up over the top of the bar and thence transversely inwardly in the direction of the arrow 132. A paper plow 133 is arranged and disposed to cause the first divided strand 118 to be folded over upon itself making a folded strand 134. Again, the plow 133 is preferably of the type shown in applicants' earlier U.S. Pat. No. 4,047,711. A vertical shear 135 is utilized to sever the folded strand 134 into separate individual stuffers. It should be understood that at this position applicants' device for making multiple page printed booklets as depicted in their prior U.S. Pat. No. 4,073,485 could be employed and thereby fold the stuffers crosswise in addition to the longitudinal folds prior to inserting those stuffers into the partially formed envelopes. A feed roll 136 is adapted to move the severed stuffers, as identified by the numeral 137, into the partially formed envelopes made from the second divided strand 119. A glue applicator 138 is adapted to apply a longitudinally disposed glue strip 139 on the flat flap portion 125 of the envelope being formed. A paper plow 140 preferably a device such as shown in applicants' prior U.S. Pat. No. 4,047,711 is used to fold the glued flap 125 over and onto the top of the previously folded over portion 123 of the preprinted paper web 116. A vertical shear 141 is provided across the path of the second divided strand 119 at the position of the completion of the folding over of the flap 125 to thereby separate the completed stuffed and sealed envelopes all made from the single continuous preprinted paper web 116. A severed completed envelope is shown at 142 and a non-separated envelope 143 is shown still as a part of the second divided and folded strand immediately prior to its being severed therefrom in the manner of the envelope 142.

FIG. 14 shows a still further modification of the invention for application particularly to the forms of the invention as shown in FIGS. 6 and 13. FIG. 14 is patterned after the device of FIG. 13. Where the devices of FIGS. 13 and 14 are identical the descriptions will not be repeated and those identical parts will be given the same reference numerals. Conversely where the structure of FIG. 14 differs from FIG. 13 the parts and their operation will be described and given new reference numerals. From a single strand of input paper web 116 the part 118 thereof is used to make envelope stuffers and the other portion 119 thereof is used to make the envelopes to receive the stuffers. It is particularly with the envelope formation that the modification of FIG. 14 is concerned.

Both the FIGS. 6 and 13 devices depict the formation of envelopes which have their address side facing downwardly. Some of the existing automatic addressing equipment now on the market is capable of only imprinting addresses on the top side of envelopes. Hence for that reason FIG. 14 shows a system where the completed and stuffed envelopes face upwardly.

A plow 144 similar to the plow 122 is repositioned so that it turns over a portion 145 of the strand 119 which is greater in extent than the remaining flat portion 146 of the strand 119. That part of the turned over top portion 145 extending beyond the underlying portion 146 is identified as the envelope flap strip 147.

A glue applicator roller 148 is adapted to apply a longitudinally disposed glue strip on the underside of the envelope flap portion 147. A paper plow 149, again preferably of the type shown in applicants' prior U.S. Pat. No. 4,047,711, is used to fold the glued flap 147 under the unturned flat portion 146 of the strand 119 so that the formed envelopes are sealed on their underside. The plow 149 in this instance is located beneath the folded over strand and is upside down relative to the plow 140 in FIG. 13. With this construction the completed and stuffed envelopes are discharged with the address side facing upwardly where printing devices can imprint an address without the sealing flap being in the way. It should be understood that the envelope fabricating devices shown herein may be arranged so that either facing or underside of completed envelopes may be up or down as desired.

The device of FIGS. 9 and 10 or the device of FIGS. 11 and 12 may be optionally used with any one of the alternative forms of the invention shown in FIGS. 1, 2, 6, 13 and 14. However, in some instances it is not a requirement to utilize means to cushion the propulsion of a stuffer being inserted into partially formed envelopes and in some instances it is not a requirement to hold the partially formed envelopes open at the stuffer receiving end of the formed web.

We are aware that numerous details of construction may be varied throughout a wide range without departing from the principles disclosed herein and we therefore do not propose limiting the patent granted hereon otherwise than as necessitated by the appended claims.

What is claimed is:

1. A device for making and stuffing envelopes comprising a continuous paper web, means moving said paper web in a longitudinal path, a first glue applicator disposed adjacent said paper web, means causing said first glue applicator to deposit a transverse glue strip at regular intervals on a portion of said paper web, a first paper plow folder positioned adjacent said paper web, said first plow folder acting to fold the continuous paper web so that the transverse glue strip containing portion of said paper web and a portion of the remaining flat portion of said paper web are disposed in superposed relation in the commencement of the making of envelopes, a supply of stuffers for the envelopes being made, means feeding a stuffer transversely of said longitudinally moving paper web into and between the folded portions of said paper web between the spaced apart transverse glue strips, a second glue applicator disposed adjacent said paper web and spaced from said first glue applicator, means causing said second glue applicator to deposit a longitudinal strip of glue to an exposed portion of the paper web not lying above or below another portion of said paper web, a second paper plow folder positioned adjacent said paper web and spaced from said first plow folder, said second plow folder acting to fold the longitudinal glue strip exposed paper web portion to a position sealing the open juncture between the previously folded portions, a shear, said shear acting to transversely shear the formed paper web at the transverse glue strips to form individual, stuffed, and sealed envelopes, said means feeding a stuffer transversely including means to retard and halt movement of the stuffer when it is fully inserted into and between the superposed portions of the paper web comprising rollers rotatable on horizontal axes and having their rolling circumferences lying in a longitudinal direction and bearing on the top of said superposed portions of said paper web at a position adjacent the fold.

2. A device as set forth in claim 1 including means for making stuffers from the same continuous paper web from which the envelopes are made comprising a slitter disposed adjacent said continuous paper web, said slitter acting to cut said paper web into first and second longitudinal strands, said envelopes being made from said first strand, a plurality of strand turning bars arranged and constructed to cause said second strand to be turned transversely outwardly of the original longitudinal path, thence longitudinally in a path generally parallel to said original path, and thence transversely inwardly, and a shear dividing said strand into individual stuffers.

3. A device as set forth in claim 2 in which there is included a paper plow folder located adjacent said second longitudinal strand when it is outwardly of the original longitudinal path whereby the stuffers are folded prior to their completion and insertion into the formed envelopes.

* * * * *